United States Patent [19]

Hammons et al.

[11] 4,322,376

[45] Mar. 30, 1982

[54] CARBURETOR

[76] Inventors: Carl A. Hammons, 10873 Meadow Glen Way; Joseph H. Martin, 10841 Meadow Glen Way, both of Escondido, Calif. 92026

[21] Appl. No.: 198,473

[22] Filed: Oct. 20, 1980

[51] Int. Cl.[3] ..... F02M 9/12

[52] U.S. Cl. ..... 261/44 A; 261/44 D; 261/DIG. 2; 261/DIG. 56

[58] Field of Search ..... 261/DIG. 2, DIG. 56, 261/44 A, 44 D

[56] References Cited

U.S. PATENT DOCUMENTS

| | | | |
|---|---|---|---|
| 1,213,807 | 1/1917 | Miller et al. | 261/44 D |
| 1,409,420 | 3/1922 | Speed . | |
| 1,563,705 | 12/1925 | Hansen-Ellehammer . | |
| 1,611,792 | 12/1926 | Sykes et al. | |
| 1,863,402 | 6/1932 | Halm . | |
| 2,726,073 | 12/1955 | Seld | 261/76 |
| 2,926,007 | 2/1960 | Pettit . | |
| 3,049,342 | 8/1962 | Hansen . | |
| 3,118,009 | 1/1964 | Phillips . | |
| 3,547,415 | 12/1970 | Perry . | |
| 3,711,068 | 1/1973 | Perry . | |
| 3,738,336 | 6/1973 | Holland . | |
| 3,746,320 | 7/1973 | Van Camp et al. | |
| 3,778,038 | 12/1973 | Eversole et al. | |
| 3,784,174 | 1/1974 | Tarnofsky | 261/DIG. 2 |
| 3,943,207 | 3/1976 | Harootian . | |
| 4,001,355 | 1/1977 | Day | 261/DIG. 2 |
| 4,034,028 | 7/1977 | Ma | 261/DIG. 56 |

FOREIGN PATENT DOCUMENTS

| | | | |
|---|---|---|---|
| 88776 | 6/1922 | Austria | 261/44 D |
| 456175 | 2/1926 | Fed. Rep. of Germany | 261/44 D |
| 457922 | 3/1928 | Fed. Rep. of Germany . | |
| 2058992 | 6/1972 | Fed. Rep. of Germany | 261/DIG. 56 |
| Ad. 21510 | 10/1920 | France . | |
| 591036 | 6/1925 | France | 261/44 D |
| 607128 | 6/1926 | France | 261/44 D |
| 113803 | 2/1926 | Switzerland . | |
| 191633 | 1/1923 | United Kingdom | 261/44 D |

*Primary Examiner*—Tim R. Miles
*Attorney, Agent, or Firm*—Duane C. Bowen

[57] ABSTRACT

A carburetor having a tapered plug adjusting air flow into the throat of a carburetor housing air passageway. A control arm connected to the plug and guided by a groove in the housing shaped to move the plug more rapidly in the upstream than in the downstream portion of the plug travel. A stationary fuel supply tube in a bore in the plug so that movement of the plug controls flow out of the fuel supply tube outlet. The outlet is sheltered and has adjacent baffles to resist fuel pickup in engine air blowback. A needle valve spindle located at the opposite side of the housing from the propeller.

7 Claims, 7 Drawing Figures

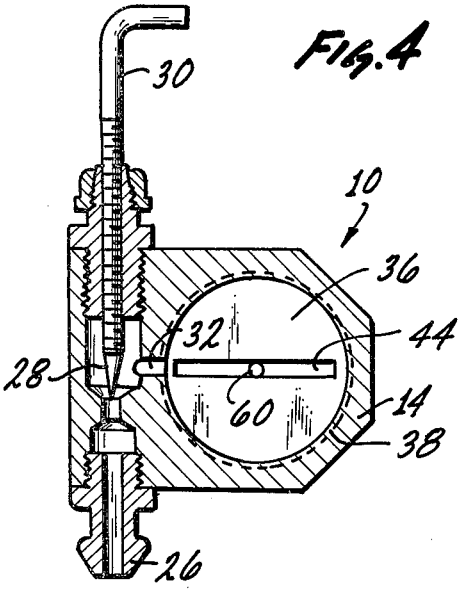
FIG. 4
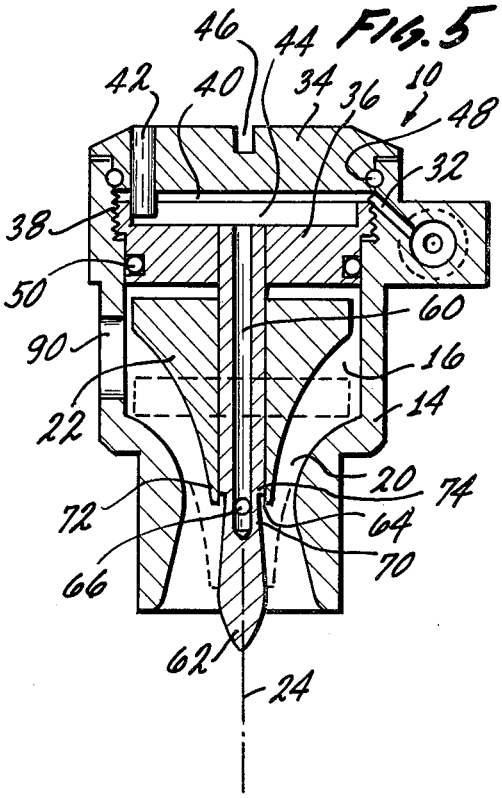
FIG. 5
FIG. 6
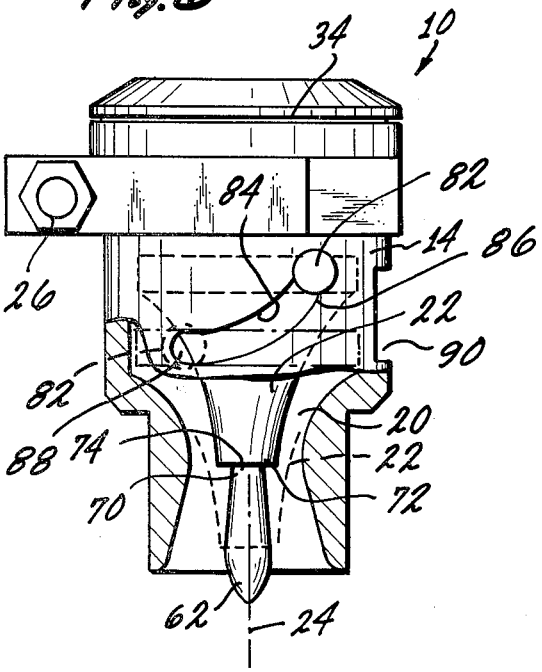
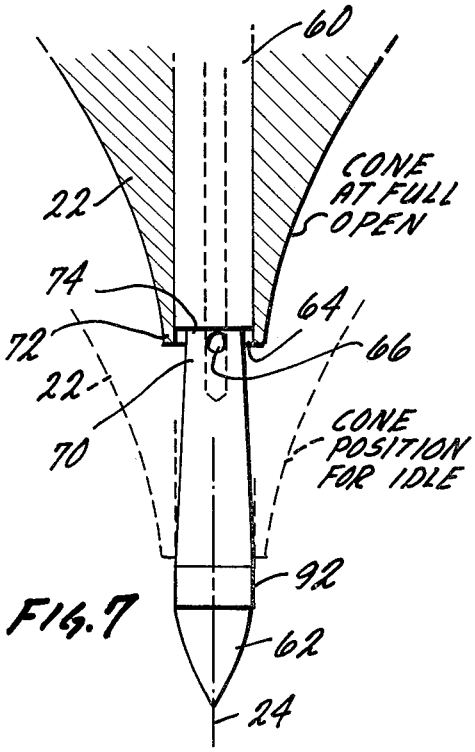
FIG. 7

CARBURETOR

BRIEF SUMMARY OF THE INVENTION, BACKGROUND AND OBJECTIVES

Our invention relates to carburetors especially for two-cycle, low-horsepower engines, such as for model airplanes, for small powered equipment like chain saws, etc.

Such carburetor may be controlled by pivoting of a control arm, around the axis of the throat of the carburetor. It is an objective of our invention that the rpm of the engine be more nearly responsive to the degrees of pivoting of the control arm about that axis than has been the case in the past.

A tapered plug may be used in the throat of this type of carburetor to control air intake to the engine by moving into and out of the carburetor throat. It is an objective to provide a fuel supply tube central of said plug, extending along said axis, in which the downstream discharge end is more or less covered by the plug in order to meter less fuel when the plug admits less air and to meter more fuel when the plug admits more air. Further, it is an objective to provide on said discharge tube a full annular reduced diameter portion which flares from smaller diameter to larger diameter downstream of said throat so that as the plug moves downstream it covers a smaller and smaller annular fuel discharge area from fuel supply tube.

Another objective is to shape the parts in proximity to the fuel discharge area to act as baffles to resist pickup of fuel in air blowback from the engine.

Another objective is to locate the manually manipulated needle valve at the side of the carburetor housing away from the propeller so there will be less chance of the hand being struck by the propeller.

DRAWINGS

FIG. 4 is a plan view, partly in section.

FIG. 5 is an elevational view, partly in section.

FIG. 6 is an elevational view, with a portion broken away to show inner structure.

FIG. 7 is an enlarged elevational view, partly in section, of cone and fuel supply tube portions of the carburetor.

DESCRIPTION

Figure 1:
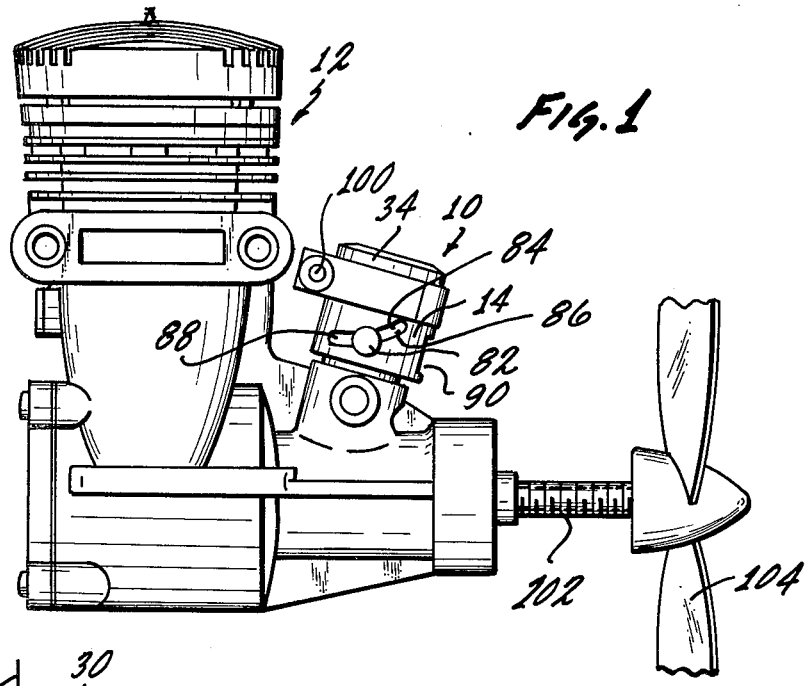
FIG. 1 is a side elevational view of a specific embodiment of our new carburetor. The carburetor is shown installed on an engine.
Figure 2:
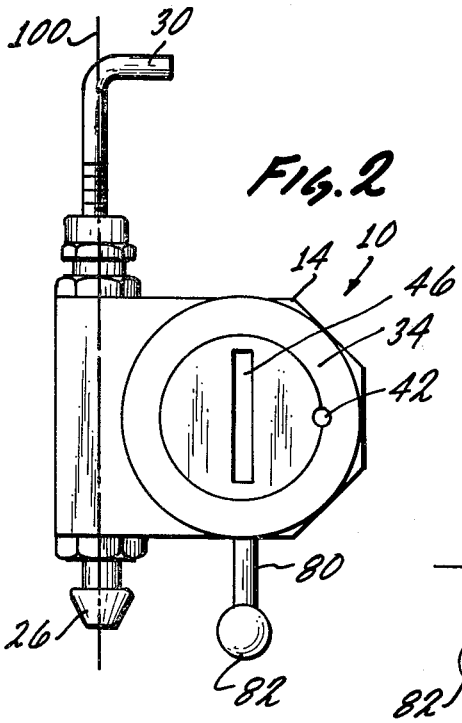
FIG. 2 is a plan view of the carburetor on enlarged scale.
Figure 3:
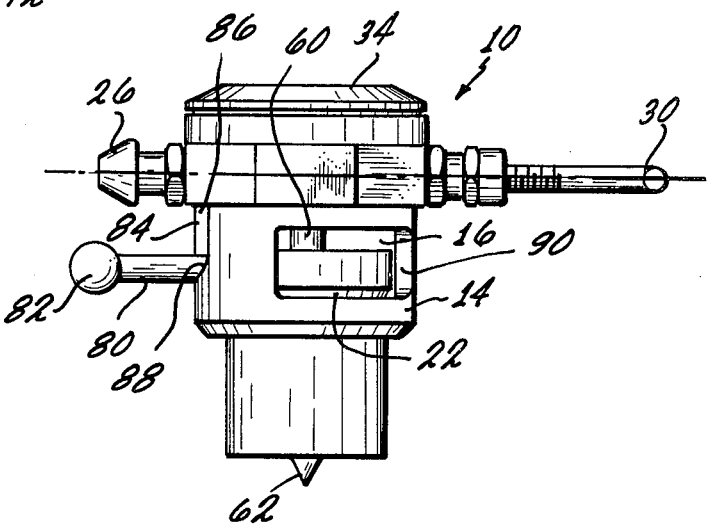
FIG. 3 is a side elevational view thereof.

Carburetor 10 is suitably and conventionally mounted on an engine 12. Most model engines use alcohol. Carburetor 10 has a housing 14 with an air passageway 16 having a throat 20 with walls that converge in a downstream direction. A plug or cone 22 tapering in a downstream direction is mounted to move along the axis 24 of passageway 16 and of throat 20 between a first upstream position permitting more air flow and a second downstream position permitting less airflow.

We will now describe some structural features that are not part of the novelty of the invention, so we will not set forth much detail on these state-of-the-art subjects. Fuel enters through a hose or tubing connected to fitting 26. Rate of flow is controlled by a threaded needle member 28 which may be screwed in or out by pivoting of the L-shaped handle end 30 of member 28. Fuel enters housing 14 at inlet 32 between cap 34 and annular plug 36 which is threadably secured at 38 in housing 14. A fuel chamber 40 is defined between cap 34 and plug 36. A drive pin 42 depends from cap 34 and fits in slot 44 in plug 36, so that as cap 34 is rotated, plug 36 is rotated which raises or lowers plug 36 because of its threaded engagement with housing 14. As plug 36 raises and lowers, the idle mixture is adjusted. Cap 34 may be rotated by use of a screwdriver in slot 46. Cap 34 and plug 36 have O-rings 48, 50 respectively sealing chamber 40. O-ring 48 fits in grooves formed both in cap 34 and housing 14 so that O-ring 48 retains cap 34 in places.

To now turn to novel structure involved in our invention, depending from annular plug 36 is a fuel supply tube 60. Tube 60 can be bonded or otherwise suitably secured to annular plug 36. Tapered plug 22 is slidably mounted on tube 60. The lower end 62 of tube 60 is formed solid and tapers from full diameter to zero diameter in a downstream direction. Tube 60 being relatively stationary with respect to annular plug 36, this means that as tapered plug 22 moves upstream and downstream it moves along tube 60. Tube 60 has a fuel outlet 64 at its end facing throat 20 and fuel outlet 64 is more or less exposed to feed fuel directly into the area of throat 20 as tapered plug 22 moves between an upstream position and a downstream position. To recapitulate, movement of tapered plug 22 simultaneously controls flow of air to throat 20 and flow of fuel from tube 60 into the airstream entering throat 20 as tapered plug 22 moves upstream and downstream.

Fuel feed for idle may be adjusted as follows. Tapered plug 22 is moved down until it practically touches throat 20 which defines minimum air feed. Then cap 10 is rotated with a screwdriver to rotate annular plug 36 which will move up or down because of its threaded connection 38 with housing 14. When annular plug 36 moves up and down, fuel supply tube 60 moves up and down relative to tapered plug 22 which can cover fuel outlet from tube 60 to a minimum fuel feed, that, together with minimum air feed will permit combustion maintenance in engine 12 at generally the lowest feasible rpm and at the leanest fuel-air mixture feasible. Instructions can be given to the user how to make this idle adjustment, which can vary depending on engine conditions, type of fuel, altitude, temperature, etc.

Fuel outlet 64 includes at least one discharge opening 66 to the side of fuel supply tube 60. Tube 60 has in the area of discharge opening 66, a full annular reduced diameter portion 70 which flares from a smaller diameter to a larger diameter from upstream to downstream of air passageway 16, whereby as tapered plug 22 moves downstream it covers a smaller and smaller annular fuel discharge area while at the same time tapered plug 22 is reducing air flow. The annular fuel discharge area has good dispersal of fuel to be picked up by the airstream passing into throat 20.

The downstream end 72 of tapered plug 22 is a generally planar end surface disposed substantially at right angles to axis 24. The upstream end 74 of the reduced diameter portion 70 of tube 60 goes from full to reduced diameter in a generally planar surface that is disposed substantially at right angles to axis 24. The feed outlet area 64 is recessed especially in the lower rpm levels, when tapered plug 22 has minimized flow of air through throat 20 and has minimized flow of fuel from discharge opening 66 and through annular reduced tube diameter portion 70. The recessed disposition of fuel outlet area 64 at lower rpm levels is shown relative to the dashed line idle position of cone 22 in FIG. 7. There is a common purpose to these three features: (a) disposition of plug end 72, (b) disposition of end 74 of reduced tube portion 70, and (c) recessing of fuel outlet area 64. That common purpose is to resist or reduce fuel pickup in air blowback from engine 12 in a reverse direction from normal in air passageway 16. Such blowback occurs at low rpm because of the advanced timing used on intake porting of 2-cycle engines to gain maximum power by increased rpm. Surfaces 72 and 74 act as baffles and area 64 is a matter of enclosure. Such back flow (sometimes called double-charging) in a two cycle engine can occur during both intake and reverse or back flow stroke. Back flow interferes in gaining a good curve of fuel-air ratios. The reasons include fuel being carried back during reverse flow and the same fuel returning to the crankcase during intake flow along with a new fuel charge. It is desirable to avoid fuel pickup during back flow as much as possible and if this is accomplished the fuel-air ratio will be enriched by approximately the same percentage factor as the reverse flow volume is relative to the total air flow volume during the intake flow. A general discussion of the subject along with some proposed solutions in various carburetors has been written by C. B. Tuckey of the Walbro Corporation and published by the Society of Automotive Engineers as Paper 710577.

A control arm 80, with a knob 82 to be manually manipulated, is attached to tapered plug 22 to move it between closed throttle and open throttle conditions. Arm 80 is guided by a groove 84 in housing 14. Groove 84 is sloped at its upstream end 86 more parallel to axis 24 and is sloped at its downstream end 88 less parallel to axis 24. These changes in slope of groove 84 means that as arm 80 is pivoted about axis 24, the tapered plug 22 is moved further along axis 24 toward or away from throat 20, per degree of pivoting of arm 80 around axis 24, at the upstream end 86 of groove 84 than at the downstream end 88. In this way, change of rpm of engine 12 more nearly responds to degree of pivoting of arm 80 about axis 24 than if groove 84 had the form mathematically defined by the helix. The user will find the carburetor better to use if engine rpm is generally responsive to the degree of pivoting of control arm 80 about air passageway, throat, and housing axis 24.

Air inlet to air passageway 16 can be through groove 84 and also through an air inlet opening 90 in housing 14. Fuel supply tube 60 has a flattened, cylindrical portion 92.

FIG. 7 indicates the relationship of parts of fuel supply tube 60 and cone 22 in full-throttle (full-lines) position and in idle (dashed-lines) position. Note that fuel supply tube 60 has a flattened, cylindrical portion 92, which usually will be close to the end 72 of cone 22 in idle position, leaving a small ring-shaped gap between cone 22 and tube 60 in idle of a few thousandths of an inch. From manufacturing considerations, it is convenient to provide cylindrical portion 92 (which can be the normal diameter of tube 60). Otherwise, the gap between cone 22 and the adjacent portions of tube 60 would relate to a first end surface 62 that is shaped conically and a second conical portion 70. Where the two would meet to form the maximum tube diameter adjacent to end 72 of plug 22 would be a function of difficult tolerances of angles and dimensions of meeting conical surfaces.

If conical plug 22 were brought down further from the dotted line showing of FIG. 7, the gap between plug 22 and tube 60 would be eliminated, to shut off the engine. Adjustment of the full throttle, idle and shut-off positions of plug 22 may be achieved by rotation of annular plug 36 by means of rotation of cap 34 connected thereto by drive pin 42 and slot recess 44 in plug 36.

Another novel feature of the carburetor is the placement of the axis 100 of needle member 28 on the opposite side of the centerline of carburetor 10 from the propeller shaft, as viewed generally in plan view. In other words, in plan view needle valve spindle 28 has a longitudinal axis 100 extending at right angles to the axis of propeller shaft 102 and axis 100 is spaced away from the propeller 104 relative to the center of the carburetor in plan view. It appears in the past to have been the practice on carburetors to center needle valves in plan view. By offsetting axis 100 away from propeller 104, there is less chance of propeller 104 hitting the fingers of one manipulating L-shaped handle end 30 of needle 28.

Having thus described my invention, I do not wish to be understood as limiting myself to the precise structure shown. Instead I wish to cover those modifications thereof which will occur to those skilled in the art upon learning of my invention and which properly fall within the scope of my invention.

I claim:

1. The improvement in a carburetor, for an engine, of the type having a housing with an air passageway having a throat and a tapered plug mounted to move along the axis of said passageway into said throat between a first upstream position permitting more air flow and a second downstream position permitting less air flow, comprising:

(a) a control arm connected to said plug and extending generally laterally relative to said axis and said housing having a groove receiving said control arm and guiding its movement, said groove as viewed with said axis therebehind being sloped at its upstream end more parallel to said axis and being sloped at its downstream end less parallel to said axis whereby as said control arm is pivoted about said axis the plug is moved farther along said axis per degree of pivoting of said arm about said axis at said upstream end of said groove than at said downstream end of said groove so that rpm of said engine more nearly responds to the degrees of pivoting of said arm than if said groove had the form defined mathematically by the helix, (b) said plug having a bore aligned with said axis and a fuel supply tube disposed in said bore, and (c) said tube being relatively stationary with respect to said plug so that as said plug moves between said upstream and downstream positions said plug moves along said tube and said tube having a fuel outlet at its end facing said throat and said fuel outlet being respectively more or less exposed to feed fuel directly into the area of said throat as said plug moves between said upstream position and said downstream position.

2. The improvement in a carburetor, for an engine, of the type having a housing with an air passageway having a throat and a tapered plug mounted to move along the axis of said passageway into said throat between a first upstream position permitting more air flow and a second downstream position permitting less air flow, comprising:

(a) a control arm connected to said plug and extending generally laterally relative to said axis and said housing having a groove receiving said control arm and guiding its movement, said groove being sloped at its upstream end more parallel to said axis and being sloped at its downstream end less parallel to said axis whereby as said control arm is pivoted about said axis the plug is moved farther along said axis per degree of pivoting of said arm about said axis at said upstream end of said groove than at said downstream end of said groove so that rpm of said engine more nearly responds to the degrees of pivoting of said arm than if said groove had the form defined mathematically by the helix, (b) said plug having a bore aligned with said axis and a fuel supply tube disposed in said bore, (c) said tube being relatively stationary with respect to said plug so that as said plug moves between said upstream and downstream positions said plug moves along said tube and said tube having a fuel outlet at its end facing said throat and said fuel outlet being respectively more or less exposed to feed fuel directly into the area of said throat as said plug moves between said upstream position and said downstream position, and (d) said tube fuel outlet including at least one opening to the side of said tube, said tube having in the area of said discharge opening a full annular reduced diameter portion which flares from a smaller diameter to a larger diameter from upstream to downstream of said passageway whereby as said plug moves downstream it covers a smaller and smaller annular fuel discharge area while at the same time said plug is reducing air flow.

3. The improvement in a carburetor, for an engine, of the type having a housing with an air passageway having a throat and a tapered plug mounted to move along the axis of said passageway into said throat between a first upstream position permitting more air flow and a second downstream position permitting less air flow, comprising:

(a) a control arm connected to said plug and extending generally laterally relative to said axis and said housing having a groove receiving said control arm and guiding its movement, said groove as viewed with said axis therebehind being sloped at its upstream end more parallel to said axis and being sloped at its downstream end less parallel to said axis whereby as said control arm is pivoted about said axis the plug is moved farther along said axis per degree of pivoting of said arm about said axis at said upstream end of said groove than at said downstream end of said groove so that rpm of said engine more nearly responds to the degrees of pivoting of said arm than if said groove had the form defined mathematically by the helix.

4. The improvement in a carburetor, for an engine, of the type having a housing with an air passageway having a throat and a tapered plug mounted to move along the axis of said passageway into said throat between a first upstream position permitting more air flow and second downstream position permitting less air flow, comprising:

(a) said plug having a bore aligned with said axis and a fuel supply tube disposed in said bore and extending beyond said plug in a downstream direction in at least said first position of said plug, (b) said tube being relatively stationary with respect to said plug so that as said plug moves between said upstream and downstream positions said plug moves along said tube and said tube having a fuel outlet at its end facing said throat and said fuel outlet being respectively more or less exposed to feed fuel directly into the area of said throat as said plug moves between said upstream position and said downstream position, and (c) said tube fuel outlet including at least one opening to the side of said tube, said tube having in the area of said discharge opening a full annular reduced diameter portion which flares from a smaller diameter to a larger diameter from upstream to downstream of said passageway whereby as said plug moves downstream it covers a smaller and smaller annular fuel discharge area while at the same time said plug is reducing air flow.

5. The subject matter of claim 4 in which the downstream end of said plug terminates in a generally planar end surface which is disposed substantially at right angles to said axis to act as a baffle to resist pickup of fuel in air blowback from said engine in a reverse direction from normal in said air passageway.

6. The subject matter of claim 4 in which the upstream end of said reduced diameter portion of said tube goes from full to reduced diameter in a generally planar surface which is disposed substantially at right angles to said axis to act as a baffle to resist pickup of fuel in air blowback from said engine in a reverse direction from normal in said air passageway.

7. The subject matter of claim 4 in which the end of said tube downstream of said reduced diameter portion ends in a solid tip tapering from full diameter to zero diameter in a downstream direction.

* * * * *